US006196518B1

(12) United States Patent
Garrido-Lecca et al.

(10) Patent No.: US 6,196,518 B1
(45) Date of Patent: Mar. 6, 2001

(54) ICE CUBE HAVING A SLIDABLE COVER

(75) Inventors: Hernán J. Garrido-Lecca, Lima (PE); Anthony Di Bitonto, Brooklyn; Davin Stowell, New York, both of NY (US)

(73) Assignee: World Kitchen, Inc., Elmira, NY (US)

( * ) Notice: Subject to any disclaimer, the term of this patent is extended or adjusted under 35 U.S.C. 154(b) by 0 days.

(21) Appl. No.: 09/221,988

(22) Filed: Dec. 29, 1998

Related U.S. Application Data

(63) Continuation-in-part of application No. 08/908,974, filed on Aug. 8, 1997, now abandoned.

(51) Int. Cl.[7] ..... F25C 1/24

(52) U.S. Cl. ..... 249/121; 221/1; 221/91; 249/119; D15/90

(58) Field of Search ..... 249/119, 121, 249/126; 221/1, 91; D15/90

(56) References Cited

U.S. PATENT DOCUMENTS

| | | | | |
|---|---|---|---|---|
| 2,182,454 | | 12/1939 | Sherman . | |
| 2,503,693 | | 4/1950 | Van Lennep . | |
| 2,932,386 | * | 4/1960 | Ushkow | 249/121 |
| 2,961,850 | | 11/1960 | Tupper . | |
| 2,980,248 | * | 4/1961 | Embring | 249/121 |
| 3,374,982 | | 3/1968 | Sallade . | |
| 3,480,251 | | 11/1969 | Pietrzak . | |
| 3,844,525 | | 10/1974 | Parmett . | |
| 4,366,941 | | 1/1983 | Harris . | |
| 4,372,526 | | 2/1983 | Daenen et al. . | |
| 4,967,995 | | 11/1990 | Burgess . | |
| 5,044,600 | | 9/1991 | Shannon . | |
| 5,188,744 | | 2/1993 | Silverman . | |
| 5,196,127 | | 3/1993 | Solell . | |
| 5,393,032 | | 2/1995 | Cederroth . | |

* cited by examiner

*Primary Examiner*—James P. Mackey
(74) *Attorney, Agent, or Firm*—Seyfarth Shaw

(57) ABSTRACT

A covered ice cube tray is provided for making, storing, and dispensing ice cubes. The cover is slidably mounted upon the tray and includes at least one leading edge that is shaped so that, as the cover is moved in relation to the tray, ice cubes are uncovered and may be dispensed one-at-a-time.

14 Claims, 7 Drawing Sheets

ICE CUBE HAVING A SLIDABLE COVER

CROSS-REFERENCE TO RELATED APPLICATION

This application is a continuation-in-part of prior patent application Ser. No. 08/908,974 filed on Aug. 8, 1997 abandoned, for "Cubeta Original Rectangular," the disclosure of which is incorporated herein by reference in its entirety as though recited in full herein.

BACKGROUND OF THE INVENTION

1. Field Of The Invention

The present invention relates to trays for making, storing, and dispensing ice cubes.

2. Description Of The Background Art

Ice cubes are a modern convenience that many people use and enjoy. Cold drinks and ice packs are just two of the more common uses of ice cubes.

Ice cubes are commonly made by using ice cube trays which are made of a relatively thin plastic or other suitable materials and which commonly have, traditionally, two parallel rows of depressions. The depressions are filled with liquid, typically water, so as to produce individual cubes. The finished ice cubes are commonly left in the trays until they are dispensed from the tray for use by the consumer.

Typically, ice cube trays do not include a cover over the top surface of the tray. A number of drawbacks exist with such uncovered ice cube trays. Absent a cover, the ice cubes may take on undesirable odors, flavors, or colors from exposure to the environment within a freezer. An uncovered tray may also acquire foreign matter within or on the ice cubes. In addition, uncovered trays are not easily stacked. Functionally, it is difficult to dispense ice cubes in a one-at-a-time fashion from traditional ice cube trays. Typically, more than the desired number of ice cubes will fall from the tray when the tray is inverted.

Previously, a few ice cube trays have included covers. However, known covered ice cube trays still have a number of drawbacks. For example, such covered ice cube trays still do not optimally address problems experienced in dispensing ice cubes one-at-a-time.

SUMMARY OF THE INVENTION

The present invention overcomes the above and other deficiencies exhibited by existing ice cube trays.

According to a first aspect of the invention, an ice cube tray for preparing, storing and dispensing ice cubes is provided which includes: a tray body having a plurality of ice cube compartments, the plurality of compartments being arranged in an array along a longitudinal axis of the tray body; a removable tray cover slidably engaged with the tray body and which uncovers the ice cube compartments as it slides upon the tray body; the tray cover including a leading edge that is configured to correspond to the array of compartments so that the ice cube compartments are uncovered one-at-a-time as the cover is slid along the tray body. The configuration of the leading edge of the tray cover thus permits ice cubes to be dispensed one-at-a-time.

In a preferred embodiment, the tray body includes engagement members comprising rails formed at opposite sides of the tray body and the cover includes channels into which the rails can be received.

The above and other aspects, features and advantages of the invention will become clear from the following description of the preferred embodiments, taken in conjunction with the accompanying drawings.

BRIEF DESCRIPTION OF THE DRAWINGS

The present invention is illustrated by way of example and not limitation in the accompanying drawings, in which like references indicate like parts, and in which.

DETAILED DESCRIPTION OF THE PREFERRED EMBODIMENTS

FIGS. 1–7 show a first embodiment of the invention having an ice cube tray with a tray body 200 and a cover a 100.

Figure 6:
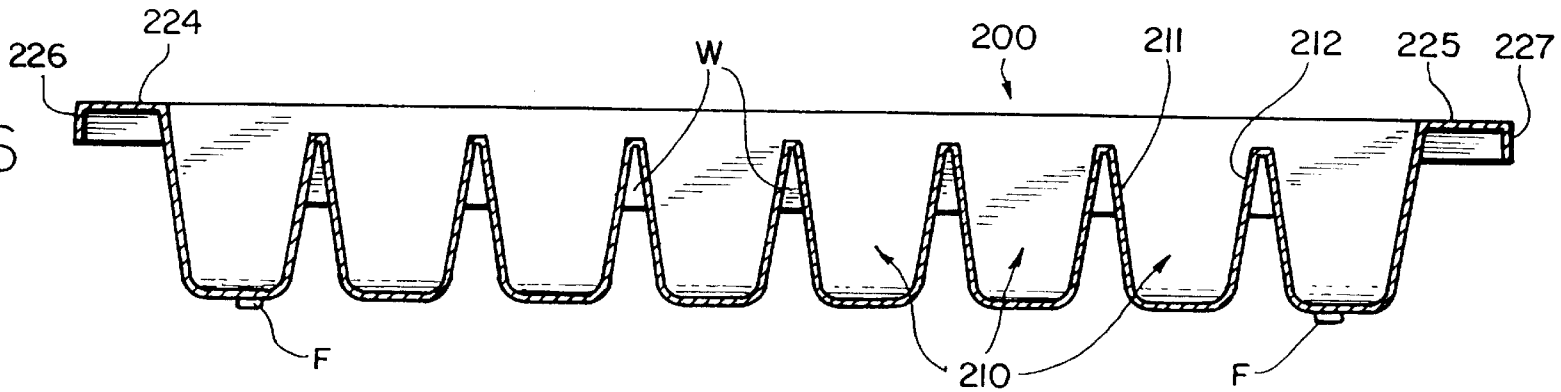
FIG. 6 is a cross-sectional side view of the tray body shown in FIG. 5 taken along a longitudinal direction of the tray body.
Figures 7, 8:
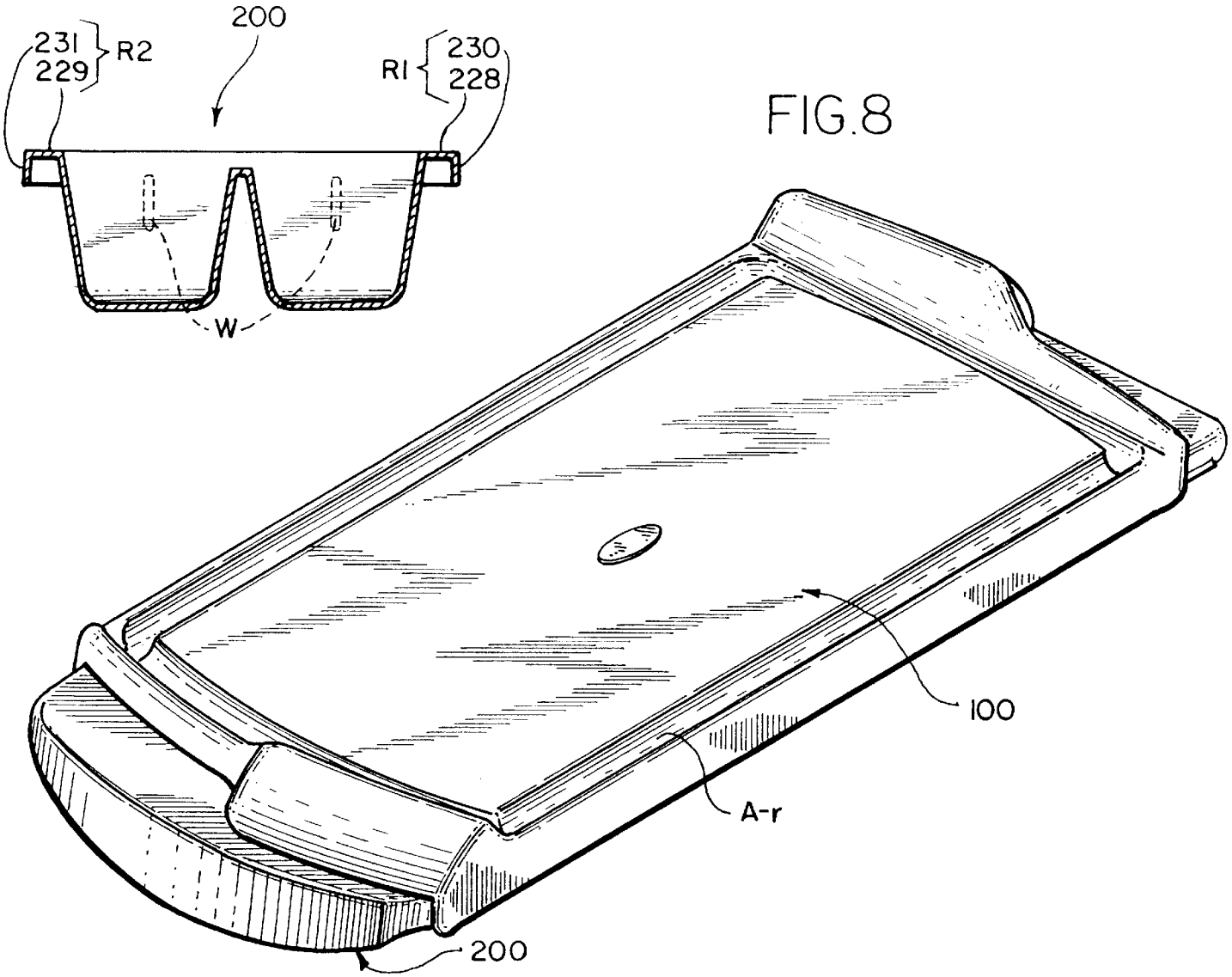
FIG. 7 is a cross-sectional side view taken along a width-wise direction of the tray body shown in FIG. 5.
FIG. 8 is a perspective top view of a tray according to a second embodiment of the invention in a fully closed position.
Figure 9:
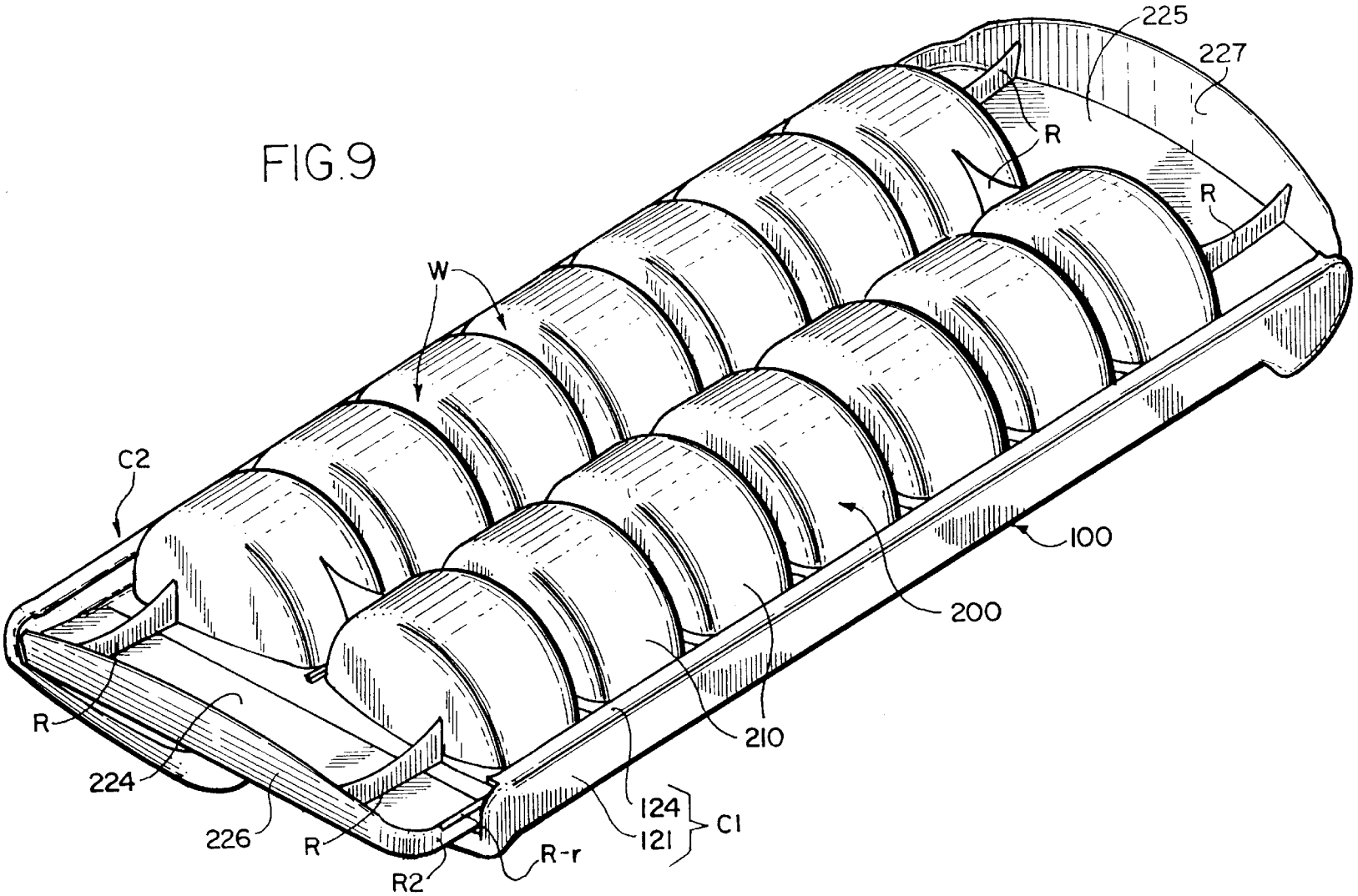
FIG. 9 is a perspective bottom view of the tray shown in FIG. 8.
Figure 10:
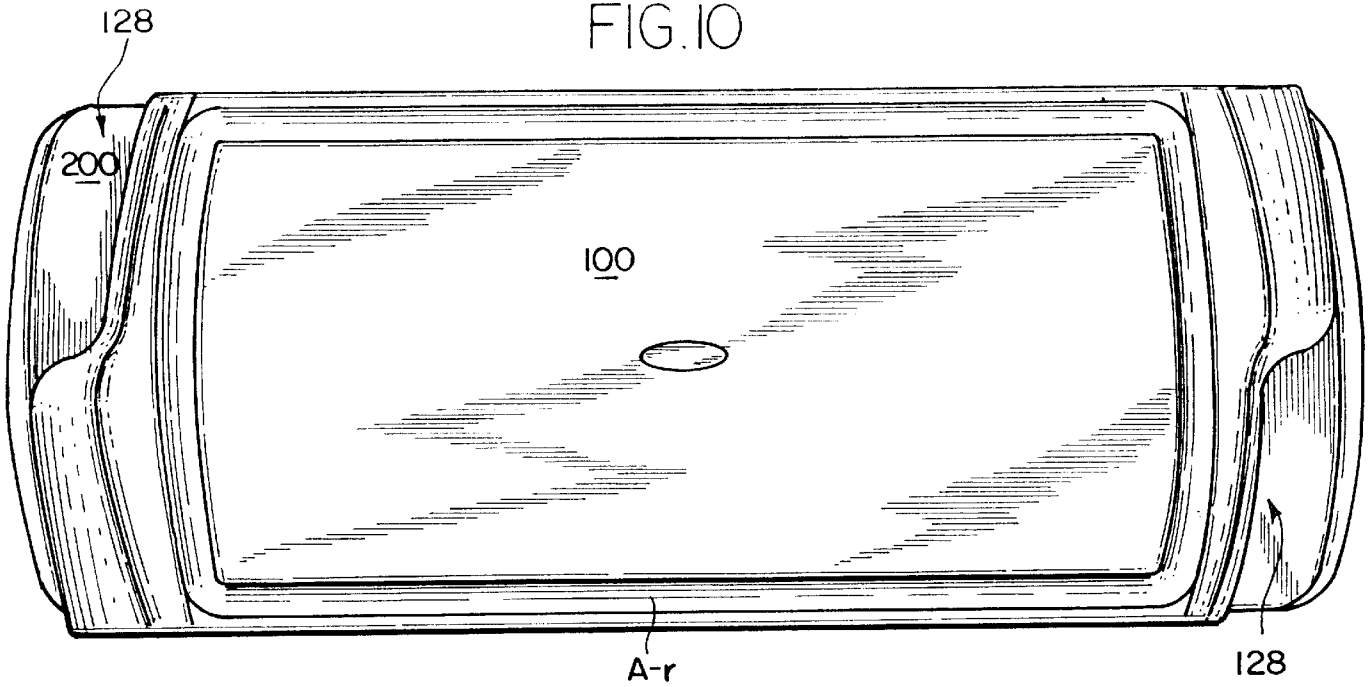
FIG. 10 is a top view of the tray shown in FIG. 8.
Figure 11:
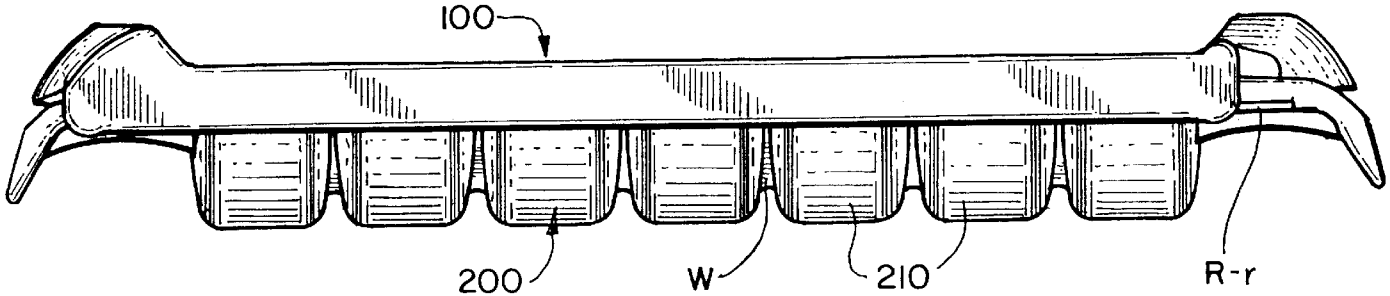
FIG. 11 is a side view of a long side of the tray shown in FIG. 8.
Figure 12:
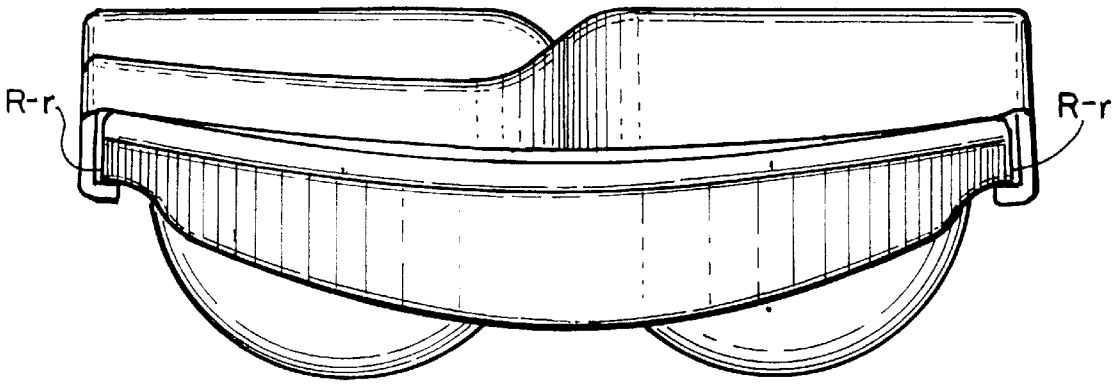
FIG. 12 is a view of an end of the tray shown in FIG. 8.
Figure 15:
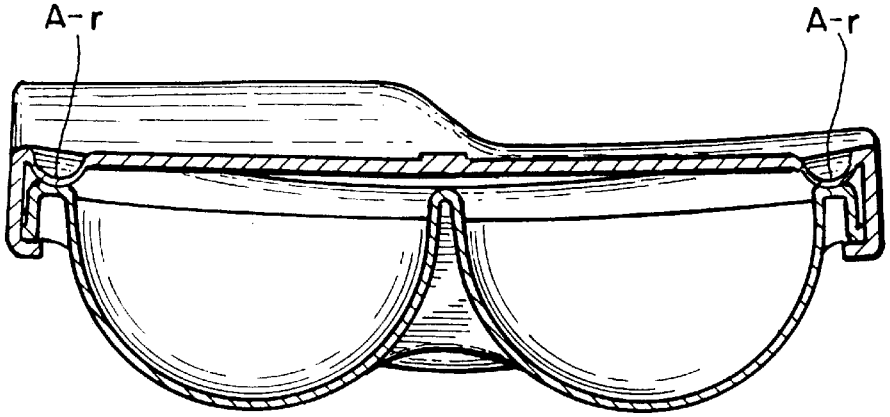
FIG. 15 is a cross-sectional end view of the tray shown in FIG. 8 along an axis perpendicular to the longitudinal axis extending through the center of two compartments in adjacent rows of compartments.

As shown, the tray body 200 includes a plurality of compartments 210 for containing ice cubes. As shown in FIGS. 6 and 7, the sides 211, 212, 213 and 214 of the compartments preferably taper inward towards their respective bottoms. The preferred compartments thus have a generally trapezoidal cross-section which can facilitate removal of ice cubes.

The compartments 210 are preferably arranged in a 2×8 array having two rows and eight compartments in each row. As discussed below, the arrangement of the compartments 210 in the tray body 200, the number of rows of compartments, and/or the number of compartments in each row can be varied depending on circumstances.

Preferably, the tray body 200 is generally rectangular with two longer sides 220 and 221 and two shorter sides 222 and 223. The shorter sides 222 and 223 preferably include outwardly extending flanges 224 and 225, respectively.

These flanges can facilitate a user's handling of the tray body 200. Preferably, the ends of the flanges 224 and 225 have downward walls 226 and 227, respectively. The longer sides 220 and 221 also preferably include outwardly extending flanges 228 and 229, respectively. As discussed below, the flanges 228 and 229 preferably operate as rails that slidably support the cover 100. The ends of the flanges 228 and 229 also preferably have downward walls 230 and 231, respectively. The flanges 224, 225, 228 and 229 can, for example, enhance the rigidity of the tray body 200. Additional reinforcing ribs can also be used depending on circumstances.

Figure 3:
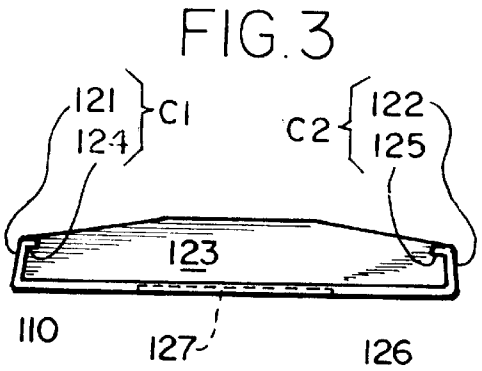
FIG. 3 is a side view of the cover shown in FIG. 1 as viewed from the left side of FIG. 1.
Figure 2:
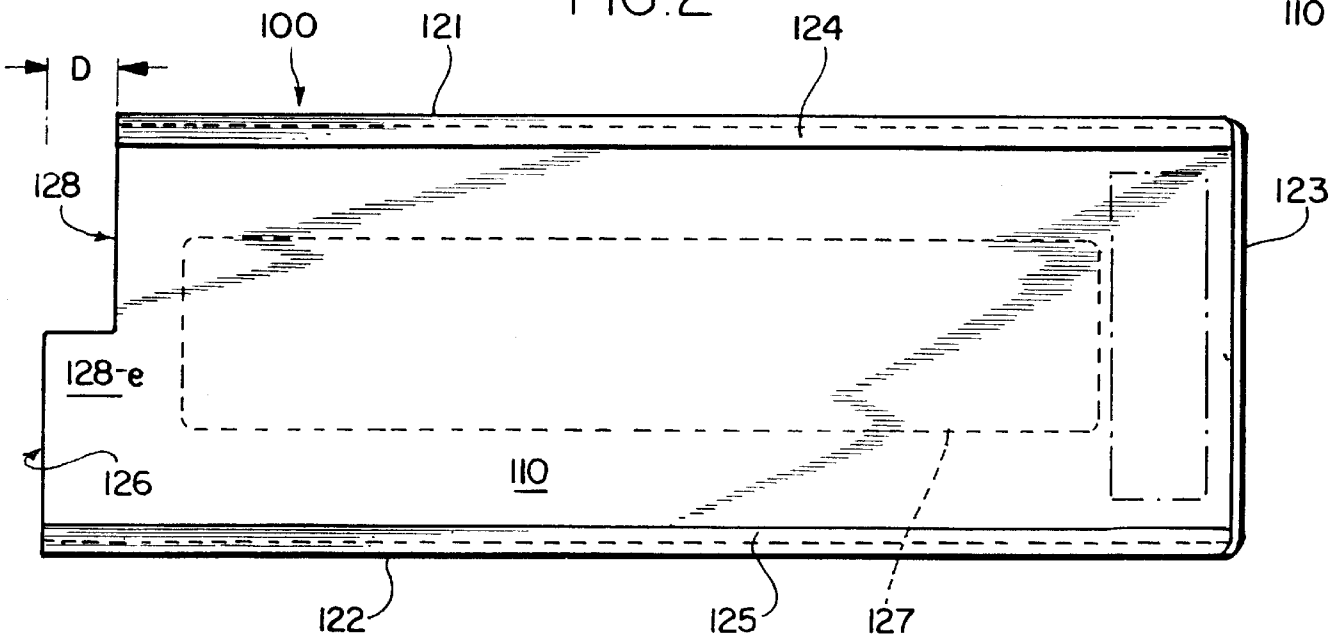
FIG. 2 is a bottom view of the cover shown in FIG. 1.

As shown in FIGS. 2 and 3, in the first embodiment, the tray cover 100 preferably includes a top wall 110, a first lengthwise sidewall 121, a second lengthwise sidewall 122, and an end wall 123. Inwardly turned flanges 124 and 125 are preferably provided at the top of the sidewalls 121 and 122, respectively. The sidewall 121 with flange 124 and the sidewall 122 with flange 125 thus preferably form two opposing channels C1 and C2, respectively, on opposite lengthwise sides of the cover 100.

Figure 4:
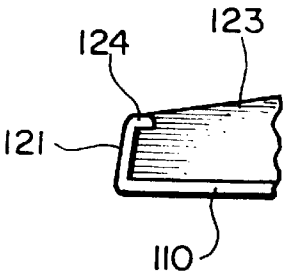
FIG. 4 is a close-up view of the left side of the cross-section shown in FIG. 3.

As shown in FIGS. 3 and 4, the end wall 123 preferably extends higher than the flanges 124 and 125. On the other hand, as shown in FIGS. 2 and 3, the leading edge 126 opposite to the end wall 123 does not contain an upstanding wall so that the leading edge 126 of the cover 100 can slide over the tray body 200 with the rails R1 and R2 fitted within the respective channels C1 and C2. The cover 100 is thus preferably configured to slidably fit over the top of the tray body 200. When the cover 100 is positioned fully over the tray body 200 in a fully-closed closed position, the wall 123 can abut the end 222 or the end 223 of the tray body. The top wall 110 is preferably sized to cover all of the compartments 210 when in a fully-closed position. Preferably, the tray body 200 is symmetrical, as shown, so that the cover can slide over either end, 222 or 223, of the tray body 200.

While a preferred engagement (e.g., via rails R1 and R2 and channels C1 and C2) to support the cover for lateral movement over the tray body is shown, this engagement can be varied depending on circumstances.

As best shown in FIG. 2, the tray cover 100 includes a leading edge 126 that is configured to correspond to the array of compartments 210 so that the ice cube compartments 210 are uncovered one-at-a-time as the cover 100 is moved, e.g., slid, along the tray body 200. The configuration of the leading edge of the tray cover thus permits ice cubes to be dispensed one-at-a-time.

In the preferred embodiment, the ice cube compartments 210 are arranged in two parallel rows and the leading edge 126 is provided with a Z-shaped configuration (e.g., stepped or staggered) so that individual compartments are fully uncovered one-at-a-time as the cover 100 is withdrawn. In the illustrated embodiment having two rows, the leading edge includes a stepped-back portion 128 aligned with the first row of compartments and a stepped-forward portion 128-*e* aligned with the second row of compartments. The stepped-forward portion 128-*e* extends forward a distance D, FIG. 2, which is smaller than the width DW, FIG. 5, of the respective compartments 210 (e.g., about half of the width DW) to enable alternating dispensation from the adjacent rows.

The invention is not limited to any particular configuration of the leading edge 126, however. Other configurations of the leading edge 126 of the cover 100, coupled with an appropriately configured array of ice cube compartments 210, can accomplish this feature of the invention. For example, the leading edge 126 can be straight and the compartments 210 in adjacent rows can be staggered.

While the leading edge 126 is preferably a foremost end of the cover 100, the leading edge can alternatively be a leading edge at a hole in the cover (e.g., such as an L-shaped hole).

In order to facilitate loosening of the ice cubes contained within the compartments, one or more of the compartments can include a soft region (not shown) at their bottoms. The soft regions can be, for example, a soft circular regions made of plastic that is softer than the plastic used for the remainder of the tray body. The soft regions can be, for example, sized to accommodate one or more of a user's fingers to enable the user to press a soft region slightly into the corresponding compartment 210 to push an ice cube therefrom. As should be apparent, the soft regions are not required in all embodiments and can be omitted if desired.

Figure 1:
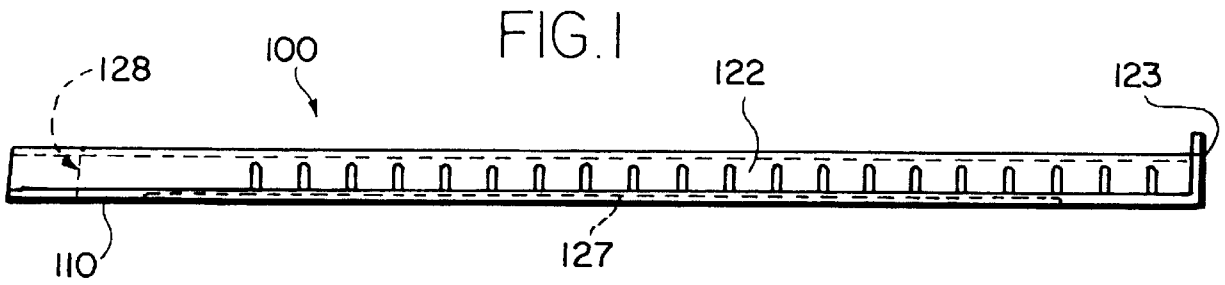
FIG. 1 is a side view of a cover for the ice cube tray according to a first preferred embodiment of the invention.
Figure 5:
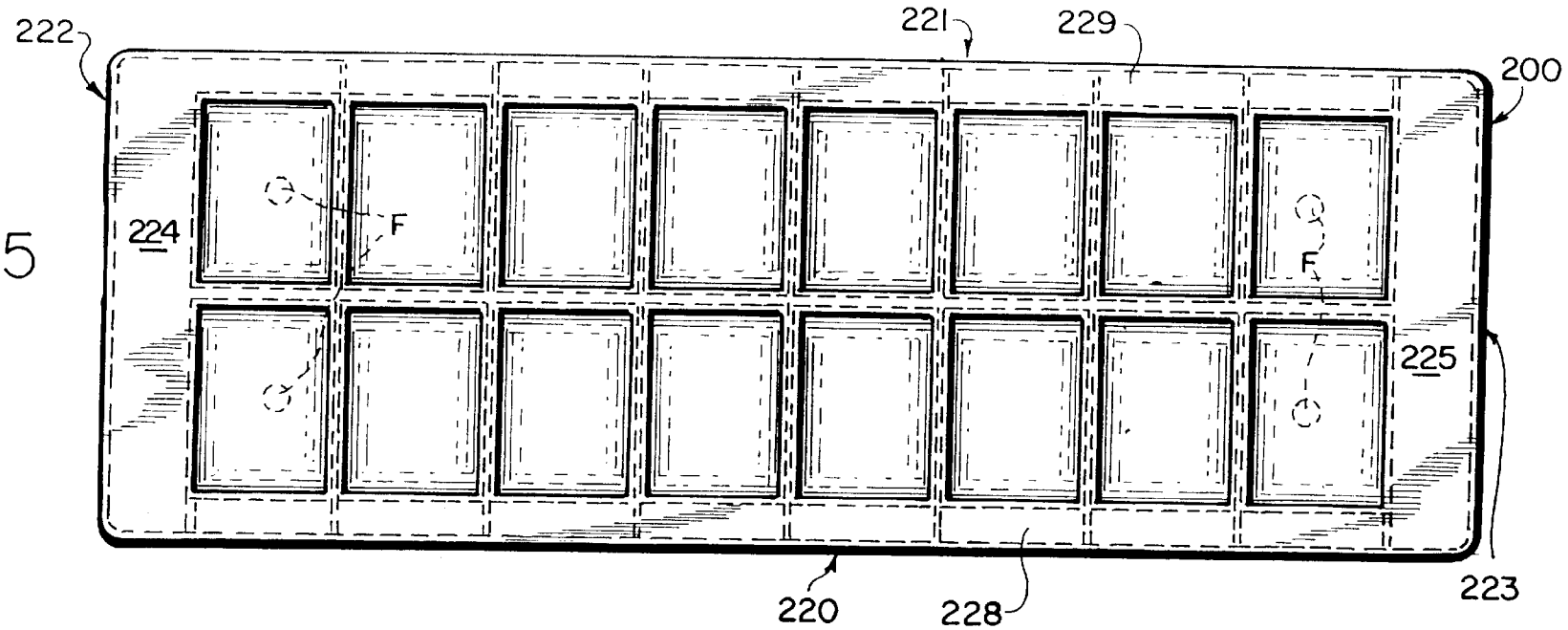
FIG. 5 is a top view of a tray body for the ice cube tray according to the first preferred embodiment of the invention.

According to another aspect of the invention, the trays can be provided with means to facilitate stacking of the trays. In this regard, as shown in FIGS. 1–3, the cover preferably includes a notch or recess 127 formed in the top wall 110. The notch or recess 127 can include, for example, an area of reduced thickness in the top wall 110. As shown in FIGS. 5 and 6, the tray body 200 preferably includes four corresponding feet F which extend down from the bottom of the tray body (e.g., from the bottoms of the corner compartments) and which are positioned to fit within a recess 127 of a second tray located therebelow when the trays are stacked upon one another. In this manner, the trays can be reliably stacked upon one another.

In use, a user can fill the compartments 210 with water, apply the cover 100 to the tray body 200 and place the assembled unit into a freezer to form ice cubes in the respective compartments. Because of the configuration of the leading edge 126 of the cover, individual compartments can be exposed one-by-one from adjacent rows as the cover is slid along the rails R1 and R2. Thus, the movement of the cover enables ice cubes to be dispensed as desired in a controlled manner, such as in single cube increments. After a desired number of ice cubes has been removed, the cover 100 can again be moved to the fully-closed position. The device can then be returned to a freezer for storage. As noted above, engaging feet and recesses can also be provided to facilitate stacking and stability during storage when placing trays on top of one another.

This first embodiment can be modified in a variety of ways without departing from the scope of the invention. For example, the shape of the compartments and the number of compartments and rows thereof can be varied. As one example, noted above, the compartments in the trays can be staggered alongside each other, in which case the leading edge can be straight and still provide for one-at-a-time ice cube removal.

FIGS. 8–15 show a second embodiment of the invention in which like reference numerals indicate items corresponding to those shown in FIGS. 1–7.

In this second embodiment, both ends of the cover 100 include edges 126 that cooperate with the layout of the ice cube compartments 210 to permit a single ice cube to be uncovered, and thus dispensed, at any one time.

Preferably, as shown in FIGS. 9–12 and 15, the rails R1 and R2 can include lengthwise ribs R–r that can facilitate sealing of the device and that can reduce the contact area between the cover 100 and the tray body 200 to facilitate opening and closing.

Figure 13:
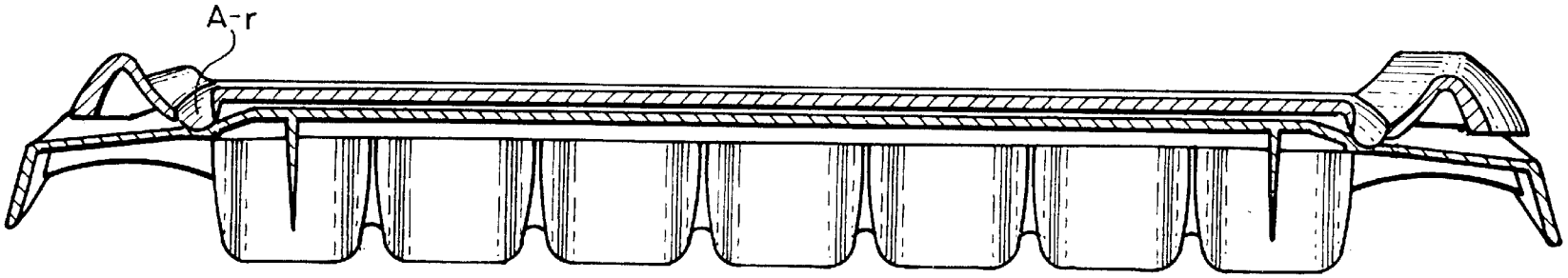
FIG. 13 is a cross-sectional side view of the tray shown in FIG. 8 along a central axis extending between the rows of compartments.
Figure 14:
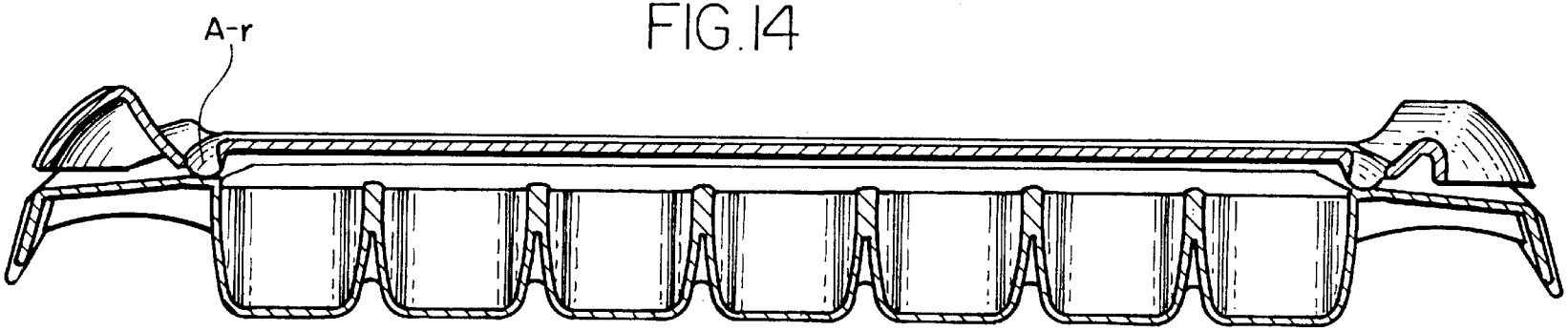
FIG. 14 is a cross-sectional side view of the tray shown in FIG. 8 along an longitudinal axis extending through the center of one of the rows of compartments.

Preferably, as shown in FIGS. 8, 10 and 13–15, the cover 100 also includes an annular recess A–r extending around the periphery of the top wall 110. As shown in FIGS. 13–14, the annular recess A–r creates an enhanced seal when the cover is in the fully-closed position. The annular recess A–r can have a reduced thickness to enhance its compliancy and thus the seal provided. Alternatively, other forms of sealing strips could be used in place of or with the annular recess A–r.

In one exemplary construction of the second embodiment, the semi-cylindrical shape of the compartments 210 can facilitate removal of ice cubes when the compartments are made with a flexible material, such as a soft plastic, by enabling a user to easily press the bottoms of the compartments upward via one's fingers to effect removal.

While the preferred embodiments of the invention have been disclosed in detail above, the invention is not intended to be limited to the embodiments as disclosed. Those skilled in the art may make numerous uses and modifications of and departures from the specific embodiments described herein without departing from the inventive concepts.

What is claimed is:

1. A tray for storing and dispensing ice cubes, comprising:

a tray body having a plurality of compartments for storing ice cubes, said plurality of compartments being arranged in a plurality of rows;

a cover sized to fit over said plurality of compartments in a closed position on said tray body, said cover being slidably supported on said tray body; and said cover having a leading edge that is configured to correspond to said rows of compartments such that the ice cube compartments are uncovered one-at-a-time from respective rows as the cover is slid along the tray body.

2. The tray of claim 1, wherein said plurality of rows is two rows.

3. The tray of claim 2, wherein there are sixteen of said compartments.

4. The tray of claim 1, wherein said rows of compartments are non-staggered with respect to one another, and wherein said leading edge of said cover is stepped such that a single compartment in a single row of said compartments is fully exposed at a time.

5. The tray of claim 1, wherein an edge of said cover opposite to said leading edge is also configured such that the ice cube compartments can be uncovered one-at-a-time from respective rows as the cover is slid along the tray body in an opposite direction so that ice cubes can be dispensed by moving the cover in either direction.

6. The tray of claim 5, wherein said edge opposite to said leading edge is stepped such that a single compartment in a single row of said compartments is fully exposed at a time.

7. The tray of claim 1, wherein said tray body includes rails formed at opposite sides of said tray body.

8. The tray of claim 7, wherein said cover includes channels formed at opposite sides of said cover into which said rails can be received.

9. The tray of claim 1, wherein an annular recess is formed around a perimeter of said cover to provide an enhanced seal between said cover and said tray body when said cover is in said closed position.

10. The tray of claim 1, wherein at least one of said compartments includes a portion formed of a soft compliant material which can be deformed to aid in the removal of an ice cube.

11. The tray of claim 1, wherein said cover has a recess for contacting a bottom surface of another tray in order to facilitate stacking of a plurality of said trays.

12. A method of storing and dispensing ice cubes, comprising the steps of:

providing a tray body having a plurality of compartments for storing ice cubes, said plurality of compartments being arranged in a plurality of rows;

providing a cover sized to fit over said plurality of compartments; and sequentially positioning said cover laterally along said tray body with said cover fully exposing a single ice cube at a time while the remaining ice cubes are located beneath said cover so as to dispense a single ice cube at a time from said plurality of compartments.

13. The method of claim 12, wherein said step of sequentially positioning includes sliding a channel disposed in a side wall of said cover along a rail disposed on said tray body.

14. The method of claim 12, wherein said step of providing a cover includes providing said cover with a stepped leading edge.

* * * * *

UNITED STATES PATENT AND TRADEMARK OFFICE

CERTIFICATE OF CORRECTION

PATENT NO. : 6,196,518 B1
DATED : March 6, 2001
INVENTOR(S) : Garrido-Lecca et al It is certified that error appears in the above-identified patent and that said Letters Patent is hereby corrected as shown below:

Title page,
Column 1,
Line 1, Item [54] "ICE CUBE HAVING A SLIDABLE COVER" should be -- ICE CUBE TRAY HAVING A SLIDABLE COVER --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*